US009777686B2

(12) United States Patent
Nehl et al.

(10) Patent No.: US 9,777,686 B2
(45) Date of Patent: Oct. 3, 2017

(54) ACTUATOR MOTION CONTROL

(71) Applicant: GM GLOBALTECHNOLOGY OPERATIONS LLC, Detroit, MI (US)

(72) Inventors: Thomas Wolfgang Nehl, Shelby Township, MI (US); Suresh Gopalakrishnan, Troy, MI (US); Avoki M. Omekanda, Rochester, MI (US); Chandra S. Namuduri, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 287 days.

(21) Appl. No.: 14/660,015

(22) Filed: Mar. 17, 2015

(65) Prior Publication Data

US 2015/0267670 A1 Sep. 24, 2015

Related U.S. Application Data

(60) Provisional application No. 61/955,963, filed on Mar. 20, 2014, provisional application No. 61/955,942, filed on Mar. 20, 2014.

(51) Int. Cl.
*F02M 51/06* (2006.01)
*F02M 65/00* (2006.01)
(Continued)

(52) U.S. Cl.
CPC ..... *F02M 51/0625* (2013.01); *F02D 41/14* (2013.01); *F02D 41/1401* (2013.01);
(Continued)

(58) Field of Classification Search
CPC .. F02D 41/14; F02D 41/20; F02D 2041/1423; F02D 2041/2024;
(Continued)

(56) References Cited

U.S. PATENT DOCUMENTS 5,381,297 A 1/1995 Weber
5,467,244 A * 11/1995 Jayawant ..... F16C 32/0448 361/144
(Continued)

FOREIGN PATENT DOCUMENTS

CN 101054930 A 10/2007
DE 34 37 053 C2 6/1985
(Continued)

OTHER PUBLICATIONS

A.M. Pawlak, Transient Finite Element Modeling of Solenoid Actuators, IEEE Transactions on Magnetics, Jan. 1988, 270-273, vol. 24, No. 1.
(Continued)

*Primary Examiner* — Ryan Reis

(57) ABSTRACT

A system for controlling actuation of an electromagnetic actuator includes an actuator having an electrical coil, a magnetic core, and an armature. A controllable drive circuit is responsive to an electric power flow signal for driving current through the electrical coil to actuate the armature. A control module includes an armature motion observer configured to determine an armature motion parameter in the actuator based upon a magnetic flux within the actuator and a predetermined mechanical equation of motion corresponding to the actuator and adapt the electric power flow signal based on the armature motion parameter.

18 Claims, 3 Drawing Sheets

(51) Int. Cl.
*F02D 41/14* (2006.01)
*F02D 41/20* (2006.01)

(52) U.S. Cl.
CPC ..... *F02D 41/20* (2013.01); *F02M 51/061* (2013.01); *F02M 51/0671* (2013.01); *F02M 65/005* (2013.01); *F02D 2041/1416* (2013.01); *F02D 2041/2051* (2013.01); *F02M 2200/08* (2013.01)

(58) Field of Classification Search
CPC ..... F02D 2041/2044; F02D 2041/2058; F02D 2041/2062; F02D 2041/2065; F02M 51/005; F02M 51/061; F02M 51/0625; F02M 65/005
See application file for complete search history.

(56) References Cited

U.S. PATENT DOCUMENTS

| | | | | |
|---|---|---|---|---|
| 5,831,809 | A | 11/1998 | Schmitz | |
| 6,168,135 | B1 | 1/2001 | Fochtman | |
| 6,321,700 | B1 | 11/2001 | Hein | |
| 6,657,847 | B1 * | 12/2003 | Wright | F01L 9/04 361/152 |
| 2001/0043450 | A1 * | 11/2001 | Seale | F01L 9/04 361/160 |
| 2002/0148442 | A1 | 10/2002 | Fraenkle | |
| 2003/0184946 | A1 | 10/2003 | Kolmanovsky | |
| 2007/0056784 | A1 | 3/2007 | Joe | |
| 2007/0120332 | A1 | 5/2007 | Bushko | |
| 2007/0285195 | A1 * | 12/2007 | Nehl | G01R 33/14 335/209 |
| 2008/0204178 | A1 | 8/2008 | Maranville | |
| 2010/0018503 | A1 | 1/2010 | Perry | |
| 2011/0125391 | A1 | 5/2011 | McAlister | |
| 2012/0018262 | A1 | 1/2012 | Winkler | |
| 2012/0101707 | A1 | 4/2012 | Kemmer | |
| 2012/0239278 | A1 | 9/2012 | Becker | |
| 2012/0247428 | A1 | 10/2012 | Grimminger | |
| 2013/0113407 | A1 | 5/2013 | Neelakantan | |
| 2013/0133748 | A1 | 5/2013 | Lehner | |
| 2014/0069533 | A1 | 3/2014 | Gorzen | |
| 2014/0092516 | A1 | 4/2014 | Koch | |
| 2014/0110508 | A1 * | 4/2014 | Dames | H01F 7/1646 239/585.1 |
| 2015/0123662 | A1 | 5/2015 | Wastling et al. | |
| 2015/0267660 | A1 | 9/2015 | Nehl | |
| 2015/0267661 | A1 | 9/2015 | Namuduri | |
| 2015/0267662 | A1 | 9/2015 | Nehl | |
| 2015/0267663 | A1 | 9/2015 | Namuduri | |
| 2015/0267666 | A1 | 9/2015 | Gopalakrishnan | |
| 2015/0267667 | A1 | 9/2015 | Namuduri | |
| 2015/0267668 | A1 | 9/2015 | Gopalakrishnan | |
| 2015/0267669 | A1 | 9/2015 | Nehl | |
| 2015/0285175 | A1 | 10/2015 | Parrish | |

FOREIGN PATENT DOCUMENTS

| | | | |
|---|---|---|---|
| DE | 196 43 788 | A1 | 5/1998 |
| DE | 199 21 938 | A1 | 12/1999 |
| DE | 10 2007 053 877 | | 4/2009 |
| DE | 10 2011 083 007 | A1 | 3/2013 |
| DE | 10 2012 208 781 | B4 | 11/2013 |
| EP | 0 074 420 | A1 | 3/1983 |
| EP | 1670005 | A2 | 6/2006 |
| EP | 2336544 | A1 | 6/2011 |
| JP | 10-311265 | A | 11/1998 |
| JP | 2007-270658 | A | 10/2007 |
| KR | 10-2002-0094494 | A | 12/2002 |
| WO | WO 90-02872 | A1 | 3/1990 |
| WO | WO 87-01765 | A1 | 3/1997 |
| WO | WO 2015 143107 | A1 | 9/2015 |
| WO | WO 2015 143109 | A1 | 9/2015 |
| WO | WO 2015 143116 | A1 | 9/2015 |

OTHER PUBLICATIONS

T.W. Nehl, ANTIC85: a General Purpose Finite Element Package for Computer Aided Design, IEEE Transactions on Magnetics, Jan. 1988, 358-361, vol. 24, No. 1.

* cited by examiner

ACTUATOR MOTION CONTROL

CROSS REFERENCE TO RELATED APPLICATIONS

This application claims the benefit of U.S. Provisional Application No. 61/955,963, filed on Mar. 20, 2014, and U.S. Provisional Application No. 61/955,942, filed on Mar. 20, 2014, both of which are incorporated herein by reference.

TECHNICAL FIELD

This disclosure is related to solenoid-activated actuators.

BACKGROUND

The statements in this section merely provide background information related to the present disclosure. Accordingly, such statements are not intended to constitute an admission of prior art.

Solenoid actuators can be used to control fluids (liquids and gases), or for positioning or for control functions. A typical example of a solenoid actuator is the fuel injector. Fuel injectors are used to inject pressurized fuel into a manifold, an intake port, or directly into a combustion chamber of internal combustion engines. Known fuel injectors include electromagnetically-activated solenoid devices that overcome mechanical springs to open a valve located at a tip of the injector to permit fuel flow therethrough. Injector driver circuits control flow of electric current to the electromagnetically-activated solenoid devices to open and close the injectors. Injector driver circuits may operate in a peak-and-hold control configuration or a saturated switch configuration.

Armatures of fuel injectors move in response to magnetic flux and magnetic force generated when the solenoid devices are electromagnetically activated. Movement of the armature overcomes biasing forces of spring activated pintles to effect opening of the fuel injectors. While the generated magnetic fluxes and magnetic forces are theoretically proportional to electrical current applied to the solenoid devices, residual magnetic flux within the fuel injectors can result in deviations from desired values. The magnetic residual flux is attributed to persistent eddy currents and magnetic hysteresis within the fuel injector as a result of shifting injected fuel mass rates that require different initial magnetic flux values. As a result, relying only upon applied current flow to the solenoid devices will result in inaccurate estimations of armature motion and position during a fuel injection event.

SUMMARY

A system for controlling actuation of an electromagnetic actuator includes an actuator having an electrical coil, a magnetic core, and an armature. A controllable drive circuit is responsive to an electric power flow signal for driving current through the electrical coil to actuate the armature. A control module includes an armature motion observer configured to determine an armature motion parameter in the actuator based upon a magnetic flux within the actuator and a predetermined mechanical equation of motion corresponding to the actuator and adapt the electric power flow signal based on the armature motion parameter

BRIEF DESCRIPTION OF THE DRAWINGS

One or more embodiments will now be described, by way of example, with reference to the accompanying drawings, in which:

FIG. 3-1 illustrates a schematic sectional view of an armature portion, mechanical spring, and an electromagnet assembly 24 of the fuel injector 10 of FIGS. 1 and 2 in the presence of magnetic flux, in accordance with the present disclosure;

FIG. 3-2 illustrates the armature portion 21 near the air gap along cross section A-A of FIG. 3-1, in accordance with the present disclosure.

DETAILED DESCRIPTION

This disclosure describes the concepts of the presently claimed subject matter with respect to an exemplary application to linear motion fuel injectors. However, the claimed subject matter is more broadly applicable to any linear or non-linear electromagnetic actuator that employs an electrical coil for inducing a magnetic field within a magnetic core resulting in an attractive force acting upon a movable armature. Typical examples include fluid control solenoids, gasoline or diesel or CNG fuel injectors employed on internal combustion engines and non-fluid solenoid actuators for positioning and control.

Figure 1:
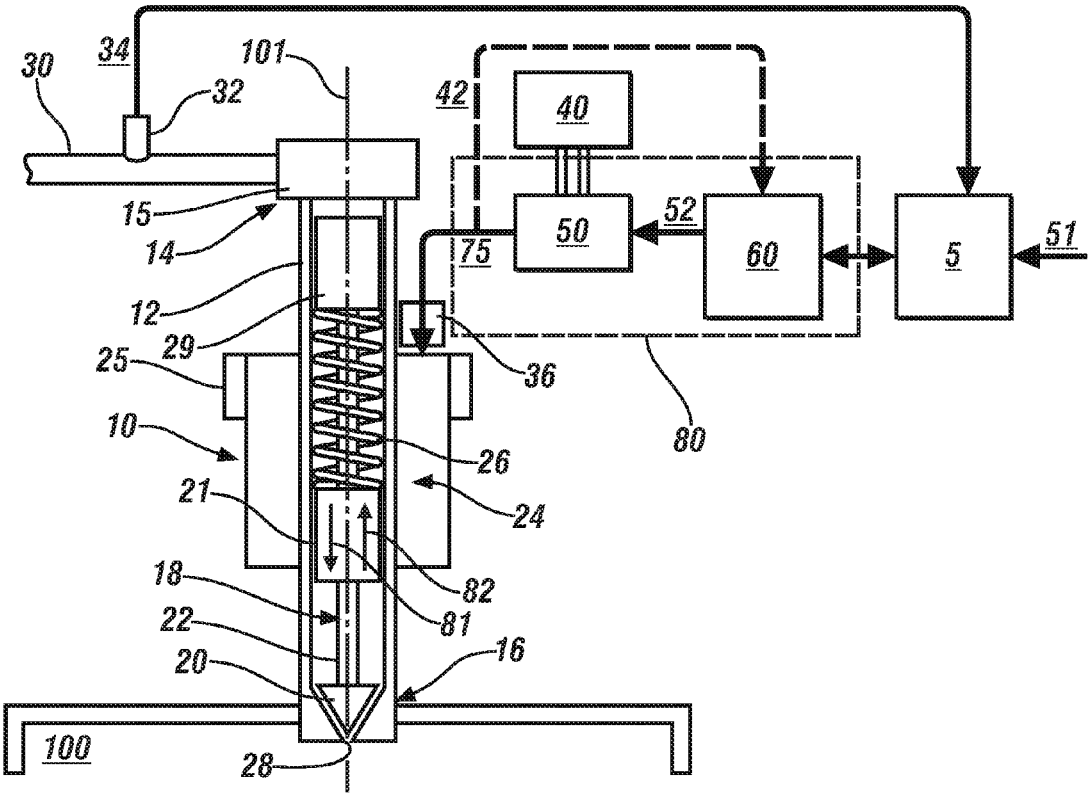
FIG. 1 illustrates a schematic sectional view of a fuel injector and an activation controller, in accordance with the present disclosure.

Referring now to the drawings, wherein the showings are for the purpose of illustrating certain exemplary embodiments only and not for the purpose of limiting the same, FIG. 1 schematically illustrates a non-limiting exemplary embodiment of an electromagnetically-activated direct-injection fuel injector 10. While an electromagnetically-activated direct-injection fuel injector is depicted in the illustrated embodiment, a port-injection fuel injector is equally applicable. The fuel injector 10 is configured to inject fuel directly into a combustion chamber 100 of an internal combustion engine. An activation controller 80 electrically operatively connects to the fuel injector 10 to control activation thereof. The activation controller 80 corresponds to only the fuel injector 10. In the illustrated embodiment, the activation controller 80 includes a control module 60 and an injector driver 50. The control module 60 electrically operatively connects to the injector driver 50 that electrically operatively connects to the fuel injector 10 to control activation thereof. Feedback signal(s) 42 may be provided from the fuel injector to the actuation controller 80. The fuel injector 10, control module 60 and injector driver 50 may be any suitable devices that are configured to operate as described herein. In the illustrated embodiment, the control module 60 includes a processing device. In one embodiment, one or more components of the activation controller 80 are integrated within a connection assembly 36 of the fuel injector 36. In another embodiment, one or more components of the activation controller 80 are integrated within a body 12 of the fuel injector 10. In even yet another embodiment, one or more components of the activation controller 80 are external to—and in close proximity with—the fuel injector 10 and electrically operatively connected to the connection assembly 36 via one or more cables and/or wires. The terms "cable" and "wire" will be used interchangeably herein to provide transmission of electrical power and/or transmission of electrical signals.

Control module, module, control, controller, control unit, processor and similar terms mean any one or various combinations of one or more of Application Specific Integrated Circuit(s) (ASIC), electronic circuit(s), central processing unit(s) (preferably microprocessor(s)) and associated memory and storage (read only, programmable read only, random access, hard drive, etc.) executing one or more software or firmware programs or routines, combinational logic circuit(s), input/output circuit(s) and devices, appropriate signal conditioning and buffer circuitry, and other components to provide the described functionality. Software, firmware, programs, instructions, routines, code, algorithms and similar terms mean any instruction sets including calibrations and look-up tables. The control module has a set of control routines executed to provide the desired functions. Routines are executed, such as by a central processing unit, and are operable to monitor inputs from sensing devices and other networked control modules, and execute control and diagnostic routines to control operation of actuators. Routines may be executed at regular intervals, for example each 3.125, 6.25, 12.5, 25 and 100 milliseconds during ongoing engine and vehicle operation. Alternatively, routines may be executed in response to occurrence of an event.

In general, an armature is controllable to one of an actuated position and a static or rest position. The fuel injector 10 may be any suitable discrete fuel injection device that is controllable to one of an open (actuated) position and a closed (static or rest) position. In one embodiment, the fuel injector 10 includes a cylindrically-shaped hollow body 12 defining a longitudinal axis 101. A fuel inlet 15 is located at a first end 14 of the body 12 and a fuel nozzle 28 is located at a second end 16 of the body 12. The fuel inlet 15 is fluidly coupled to a high-pressure fuel line 30 that fluidly couples to a high-pressure injection pump. A valve assembly 18 is contained in the body 12, and includes a needle valve 20, a spring-activated pintle 22 and an armature portion 21. The needle valve 20 interferingly seats in the fuel nozzle 28 to control fuel flow therethrough. While the illustrated embodiment depicts a triangularly-shaped needle valve 20, other embodiments may utilize a ball. In one embodiment, the armature portion 21 is fixedly coupled to the pintle 22 and configured to linear translate as a unit with the pintle 22 and the needle valve 20 in first and second directions 81, 82, respectively. In another embodiment, the armature portion 21 may be slidably coupled to the pintle 22. For instance, the armature portion 21 may slide in the first direction 81 until being stopped by a pintle stop fixedly attached to the pintle 22. Likewise, the armature portion 21 may slide in the second direction 82 independent of the pintle 22 until contacting a pintle stop fixedly attached to the pintle 22. Upon contact with the pintle stop fixedly attached to the pintle 22, the force of the armature portion 21 causes the pintle 22 to be urged in the second direction 82 with the armature portion 21. The armature portion 21 may include protuberances to engage with various stops within the fuel injector 10.

An annular electromagnet assembly 24, including an electrical coil and magnetic core, is configured to magnetically engage the armature portion 21 of the valve assembly. The electrical coil and magnetic core assembly 24 is depicted for illustration purposes to be outside of the body of the fuel injector; however, embodiments herein are directed toward the electrical coil and magnetic core assembly 24 to be either integral to, or integrated within, the fuel injector 10. The electrical coil is wound onto the magnetic core, and includes terminals for receiving electrical current from the injector driver 50. Hereinafter, the "electrical coil and magnetic core assembly" will simply be referred to as an "electrical coil 24". When the electrical coil 24 is deactivated and de-energized, the spring 26 urges the valve assembly 18 including the needle valve 20 toward the fuel nozzle 28 in the first direction 81 to close the needle valve 20 and prevent fuel flow therethrough. When the electrical coil 24 is activated and energized, electromagnetic force (herein after "magnetic force") acts on the armature portion 21 to overcome the spring force exerted by the spring 26 and urges the valve assembly 18 in the second direction 82, moving the needle valve 20 away from the fuel nozzle 28 and permitting flow of pressurized fuel within the valve assembly 18 to flow through the fuel nozzle 28. A search coil 25 is mutually magnetically coupled to the electrical coil 24 and is preferably wound axially or radially adjacent coil 24. Search coil 25 is utilized as a sensing coil.

The fuel injector 10 may include a stopper 29 that interacts with the valve assembly 18 to stop translation of the valve assembly 18 when it is urged to open. In one embodiment, a pressure sensor 32 is configured to obtain fuel pressure 34 in the high-pressure fuel line 30 proximal to the fuel injector 10, preferably upstream of the fuel injector 10. In another embodiment, a pressure sensor may be integrated within the inlet 15 of the fuel injector in lieu of the pressure sensor 32 in the fuel rail 30 or in combination with the pressure sensor. The fuel injector 10 in the illustrated embodiment of FIG. 1 is not limited to the spatial and geometric arrangement of the features described herein, and may include additional features and/or other spatial and geometric arrangements known in the art for operating the fuel injector 10 between open and closed positions for controlling the delivery of fuel to the engine 100.

The control module 60 generates an injector command (actuator command) signal 52 that controls the injector driver 50, which activates the fuel injector 10 to the open position for affecting a fuel injection event. In the illustrated embodiment, the control module 60 communicates with one or more external control modules such as an engine control module (ECM) 5; however, the control module 60 may be integral to the ECM in other embodiments. The injector command signal 52 correlates to a desired mass of fuel to be delivered by the fuel injector 10 during the fuel injection event. Similarly, the injector command signal 52 may correlate to a desired fuel flow rate to be delivered by the fuel injector 10 during the fuel injection event. As used herein, the term "desired injected fuel mass" refers to the desired mass of fuel to be delivered to the engine by the fuel injector 10. As used herein, the term "desired fuel flow rate" refers to the rate at which fuel is to be delivered to the engine by the fuel injector 10 for achieving the desired mass of fuel. The desired injected fuel mass can be based upon one or more monitored input parameters 51 input to the control module 60 or ECM 5. The one or more monitored input parameters 51 may include, but are not limited to, an operator torque request, manifold absolute pressure (MAP), engine speed, engine temperature, fuel temperature, and ambient temperature obtained by known methods. The injector driver 50 generates an injector activation (actuator activation) signal 75 in response to the injector command signal 52 to activate the fuel injector 10. The injector activation signal 75 controls current flow to the electrical coil 24 to generate electromagnetic force in response to the injector command signal 52. An electric power source 40 provides a source of DC electric power for the injector driver 50. In some embodiments, the DC electric power source provides low voltage, e.g., 12 V, and a boost converter may be utilized to output a high voltage, e.g., 24V to 200 V, that is supplied to the injector driver 50. When activated using the injector activation signal 75, the electromagnetic force generated by the electrical coil 24 urges the armature portion 21 in the second direction 82. When the armature portion 21 is urged in the second direction 82, the valve assembly 18 in consequently caused to urge or translate in the second direction 82 to an open position, allowing pressurized fuel to flow therethrough. The injector driver 50 controls the injector activation signal 75 to the electrical coil 24 by any suitable method, including, e.g., pulsewidth-modulate (PWM) electric power flow. The injector driver 50 is configured to control activation of the fuel injector 10 by generating suitable injector activation signals 75. In embodiments that employ a plurality of successive fuel injection events for a given engine cycle, an injector activation signal 75 that is fixed for each of the fuel injection events within the engine cycle may be generated.

The injector activation signal 75 is characterized by an injection duration and a current waveform that includes an initial peak pull-in current and a secondary hold current. The initial peak pull-in current is characterized by a steady-state ramp up to achieve a peak current, which may be selected as described herein. The initial peak pull-in current generates electromagnetic force that acts on the armature portion 21 of the valve assembly 18 to overcome the spring force and urge the valve assembly 18 in the second direction 82 to the open position, initiating flow of pressurized fuel through the fuel nozzle 28. When the initial peak pull-in current is achieved, the injector driver 50 reduces the current in the electrical coil 24 to the secondary hold current. The secondary hold current is characterized by a somewhat steady-state current that is less than the initial peak pull-in current. The secondary hold current is a current level controlled by the injector driver 50 to maintain the valve assembly 18 in the open position to continue the flow of pressurized fuel through the fuel nozzle 28. The secondary hold current is preferably indicated by a minimum current level. The injector driver 50 is configured as a bi-directional current driver capable of providing a negative current flow for drawing current from the electrical coil 24. As used herein, the term "negative current flow" refers to the direction of the current flow for energizing the electrical coil to be reversed. Accordingly, the terms "negative current flow" and "reverse current flow" are used interchangeably herein.

Embodiments herein are directed toward controlling the fuel injector for a plurality of fuel injection events that are closely-spaced during an engine cycle. As used herein, the term "closely-spaced" refers to a dwell time between each consecutive fuel injection event being less than a predetermined dwell time threshold. As used herein, the term "dwell time" refers to a period of time between an end of injection for the first fuel injection event (actuator event) and a start of injection for a corresponding second fuel injection event (actuator event) of each consecutive pair of fuel injection events. The dwell time threshold can be selected to define a period of time such that dwell times less than the dwell time threshold are indicative of producing instability and/or deviations in the magnitude of injected fuel mass delivered for each of the fuel injection events. The instability and/or deviations in the magnitude of injected fuel mass may be responsive to a presence of secondary magnetic effects. The secondary magnetic effects include persistent eddy currents and magnetic hysteresis within the fuel injector and a residual flux based thereon. The persistent eddy currents and magnetic hysteresis are present due to transitions in initial flux values between the closely-spaced fuel injection events. Accordingly, the dwell time threshold is not defined by any fixed value, and selection thereof may be based upon, but not limited to, fuel temperature, fuel injector temperature, fuel injector type, fuel pressure and fuel properties such as fuel types and fuel blends. As used herein, the term "flux" refers to magnetic flux indicating the total magnetic field generated by the electrical coil 24 and passing through the armature portion. Since the turns of the electrical coil 24 link the magnetic flux in the magnetic core, this flux can therefore be equated from the flux linkage. The flux linkage is based upon the flux density passing through the armature portion, the surface area of the armature portion adjacent to the air gap and the number of turns of the coil 24. Accordingly, the terms "flux", "magnetic flux" and "flux linkage" will be used interchangeably herein unless otherwise stated.

For fuel injection events that are not closely spaced, a fixed current waveform independent of dwell time may be utilized for each fuel injection event because the first fuel injection event of a consecutive pair has little influence on the delivered injected fuel mass of the second fuel injection event of the consecutive pair. However, the first fuel injection event may be prone to influence the delivered injected fuel mass of the second fuel injection event, and/or further subsequent fuel injection events, when the first and second fuel injection events are closely-spaced and a fixed current wave form is utilized. Any time a fuel injection event is influenced by one or more preceding fuel injection events of an engine cycle, the respective delivered injected fuel mass of the corresponding fuel injection event can result in an unacceptable repeatability over the course of a plurality of engine cycles and the consecutive fuel injection events are considered closely-spaced. More generally, any consecutive actuator events wherein residual flux from the preceding actuator event affects performance of the subsequent actuator event relative to a standard, for example relative to performance in the absence of residual flux, are considered closely-spaced.

In some embodiments, the fuel injector 10 of FIG. 1 may include a search coil 25 that is mutually magnetically coupled to the electrical coil portion and wound onto the magnetic core portion of the electrical coil and magnetic core assembly 24. This disclosure may interchangeably refer to the electrical coil 24 as a "main coil". The search coil 25 is depicted for illustration purposes to be outside of the body of the fuel injector; however, embodiments herein are directed toward the search coil 25 to be either integral to, or integrated within, the fuel injector 10. The search coil 25 is positioned within a magnetic field path generated by the main coil 24. Therefore, the search coil 25 is not limited to any specific configuration or spatial orientation. In one embodiment, the search coil 25 is wound adjacent to the main coil 24. In another embodiment, the search coil 25 is wound around the main coil 24. The search coil 25 can include terminal leads electrically connected to a voltage sensor. The search coil 25 can be utilized for obtaining the magnetic flux within the fuel injector 10. For instance, a flux-linkage of the search coil 25 may generate a voltage in the search coil 25 in accordance with the following relationship:

$$V_{SC} = \frac{d\lambda}{dt} \quad [1]$$

wherein $V_{SC}$ is the search coil voltage, $\lambda$ is the flux-linkage, and t is time.

The magnetic flux within an air gap of the fuel injector thus may be obtained from an integration in accordance with the following relationship:

$$\varphi = \frac{1}{N}\int V_{SC}dt + \varphi_o \quad [2]$$

wherein $\phi$ is the magnetic flux in the air gap, $\phi_o$ is the initial (residual) flux, and N is a prescribed number of turns in the search coil.

Accordingly, the search coil 25 can serve as one of the sensor devices within the fuel injector that provide information to the control module 60 via the feedback signal(s) 42. The initial flux can be set to zero using a degaussing or flux reset procedure.

Moreover, the flux-linkage of the search coil 25 determined by EQ. [1] is substantially identical to that of the main coil 24 based on the mutually magnetic coupling therebetween. Advantageously, values for flux linkage and magnetic flux within the fuel injector can be determined even without directly monitoring voltage (such as with a search coil as described above) through other parameters. Main coil voltage, current and resistance can be used in the following relationship to attain the flux linkage:

$$V_{MC} = R \times i + \frac{d\lambda}{dt} \quad [3]$$

wherein $V_{MC}$ is the main coil voltage, $\lambda$ is the flux-linkage,

R is the resistance of the main coil, i is the measured current through the main coil, and t is time.

The magnetic flux within an air gap of the fuel injector thus may be obtained from an integration in accordance with the following relationship:

$$\varphi = \frac{1}{N}\int (V_{MC} - Ri)dt + \varphi_o \quad [4]$$

wherein $\phi$ is the magnetic flux in the air gap,

N is a prescribed number of turns in the main coil, $\phi_o$ is the initial (residual) flux, R is the resistance of the main coil, i is the current through the main coil, and t is time.

Accordingly, magnetic flux can be determined without a separate search coil. Either way, the magnetic flux can be provided via the feedback signal(s) 42 to the control module 60 of the activation controller 80.

In other embodiments, a magnetic field sensor such as a hall sensor may be positioned within a magnetic flux path within the fuel injector for measuring the magnetic flux. Similarly, other magnetic field sensors can be utilized to measure the magnetic flux such as, but not limited to, analog hall sensors and Magnetoresistive (MR) type sensors. The magnetic flux measured by such magnetic field sensors can be provided via feedback signal(s) 42 to the control module 60. It is understood that these magnetic field sensors are indicative of sensing devices integrated within the fuel injector for obtaining the active magnetic flux. It will be understood that embodiments herein are not intended to be limited any one technique for determining the magnetic flux or the equivalent flux linkage within the fuel injector 10.

Figure 2:
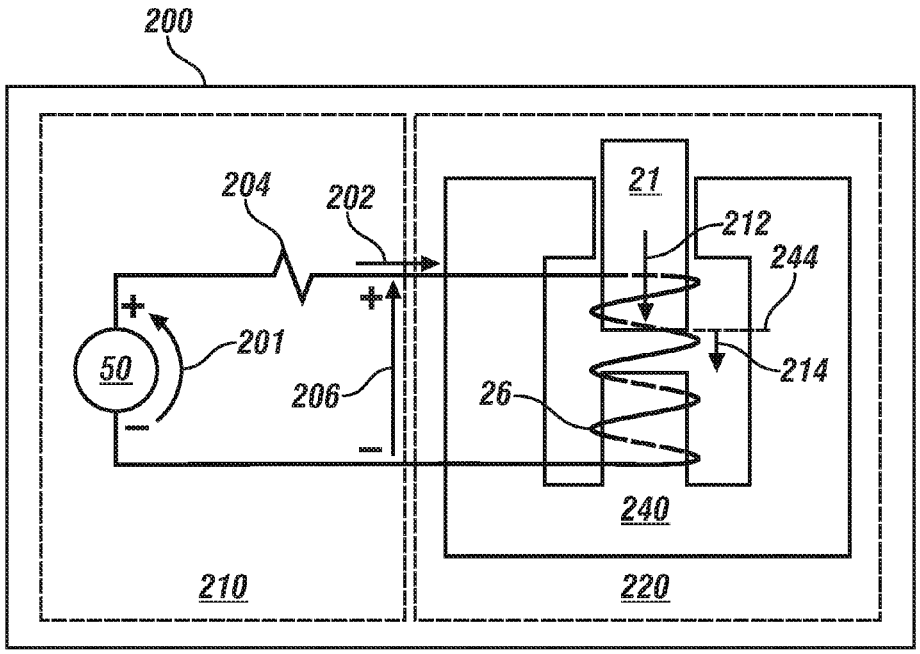
FIG. 2 schematically illustrates a transient armature model for estimating magnetic force within the fuel injector 10 of FIG. 1, in accordance with the present disclosure.

FIG. 2 schematically illustrates a transient armature position model for estimating an instantaneous position, velocity and acceleration of the armature portion 21 of the fuel injector 10 of FIG. 1, in accordance with the present disclosure. The transient armature model 200 can be implemented within—and executed by a processing device of—the control module 60 and/or external ECM 5 of FIG. 1. The transient armature model 200 includes an electrical subsystem 210 and a magnetic, fluid and mechanical (MFM) subsystem 220. The transient armature model 200 will be described with reference to the fuel injector 10 and activation controller 80 of FIG. 1. The injector driver 50, armature portion 21, and the stationary magnetic core 240 of the electrical core and electromagnet assembly 24 are further illustrated to portray relationships between parameters of coil drive voltage 201, coil drive current 202, total series resistance 204, voltage for flux-linkage calculation 206, magnetic force 212 and position of the armature portion 21. In the illustrated embodiment, it will be assumed that the magnetic force 212 and the position 214 of the armature portion are unknown. Dashed horizontal line 244 indicates the position 214 of the armature portion 21 is equal to zero. When the position 214 is zero, it will be understood that the armature portion 21 is not moving and is biased in the first direction 81 of FIG. 1 by the mechanical spring 26; that is, the injector is closed preventing fuel flow to the engine 100.

The electrical subsystem 210 can represent the flux-linkage of the electrical coil and a voltage provided from the injector driver 50 based upon the following relationship:

$$v(t) = i(t)R(T(t)) + \frac{d\lambda(i(t)), s(t)}{dt} \quad [5]$$

wherein v is the voltage 201 provided from the injector driver, $\lambda$ is the flux-linkage 206, R is the total series resistance 204 of the main coil, cables and reflected eddy current resistances, i is the measured current 202 through the main coil, t is time, T is a temperature of the main coil, and s is a position 214 of the armature.

It will be appreciated that some embodiments may incorporate the search coil 25 to indirectly obtain the flux-linkage 206 utilizing EQ. [1] as described above.

The MFM sub-system 220 of the transient armature position model 200 can represent the magnetic force 212 acting upon the moving armature portion 21 and the position 214 of the armature 21 based on the following relationship of motion from which one skilled in the art will recognize position, velocity, and acceleration terms:

$$f_{mag} = [k_1(s)m_1 + k_2(s)m_2 + \ldots]\frac{d^2s}{dt^2} + c(s, T)\frac{ds}{dt} + k(s, T)s + f_{plp}(s, p) + f_{pl}(T) \quad [6]$$

wherein $f_{mag}$ is the magnetic force 212 acting upon the armature, $m_1$ is a moving mass of a first portion of the armature, $m_2$ is a moving mass of a second portion of the armature, $k_1(s)$ is equal to 1 when the first portion of the armature 21 is moving, $k_2(s)$ is equal to 0 when the first and second portions of the armature 21 are decoupled and is equal to 1 when the first and second portions are coupled, c is a viscous damping coefficient which may be a function of position s and temperature T, p is the fuel pressure, k is a spring constant of the spring which may be a function of position s and temperature T, $f_{plp}$ is a position and fuel pressure dependent force upon the armature in the closed position, and $f_{pl}$ is a preload of the spring which may be a function of temperature T, T is temperature.

It will be understood that the first moving mass, $m_1$, of the first portion of the armature can include the armature portion 21 moving in the second direction 82 prior to coupling with the second portion of the armature which may include a pintle 22 or a stop coupled to the pintle. Likewise, the second moving mass, $m_2$, of the second portion of the armature 21 can include the armature portion 21 moving in the second direction 82 while coupled to the stop or the pintle 22. EQ. [6] can be applied to the armature portion 21 moving with more than two masses. The magnetic force acting upon the armature can be determined based upon relationships described below in FIGS. 3-1 and 3-2. Parameters such as mass, the spring constant, viscous damping coefficient and the preload of the spring can be stored within a memory device of the control module 60. Moreover, while the particular terms of EQ. [6] are set forth with respect to a fuel injector, more general or detailed forms of the equation applicable to other types of electromagnetic actuator applications will be readily apparent to one having ordinary skill in the art with an understanding of the unique structures and forces of the particular actuator application. For instance, a single mass armature would use a similar equation with a combined mass term. And, while EQ. [6] includes a fuel pressure dependent force, a more general form of the equation applicable to other actuators not subjected to similar forces would not include such a force term or would include force terms that are applicable to the specific hardware configuration. Moreover, spring preloading and spring constant terms would likewise be adapted or eliminated altogether in accordance with specific hardware configurations, for example eliminating the spring constant term but maintaining a force preload in the case of a magnetically latching solenoid. Other variations will be apparent to one having ordinary skill in the art and the specific form and terms of EQ. [6] are merely exemplary and not limiting of the application of an armature motion relationship in accordance with the present disclosure. Therefore, a more general relationship may be represented by at least an armature mass and acceleration term and a single force term to include an aggregation of additional forces acting upon the armature.

Figures 1, 3:
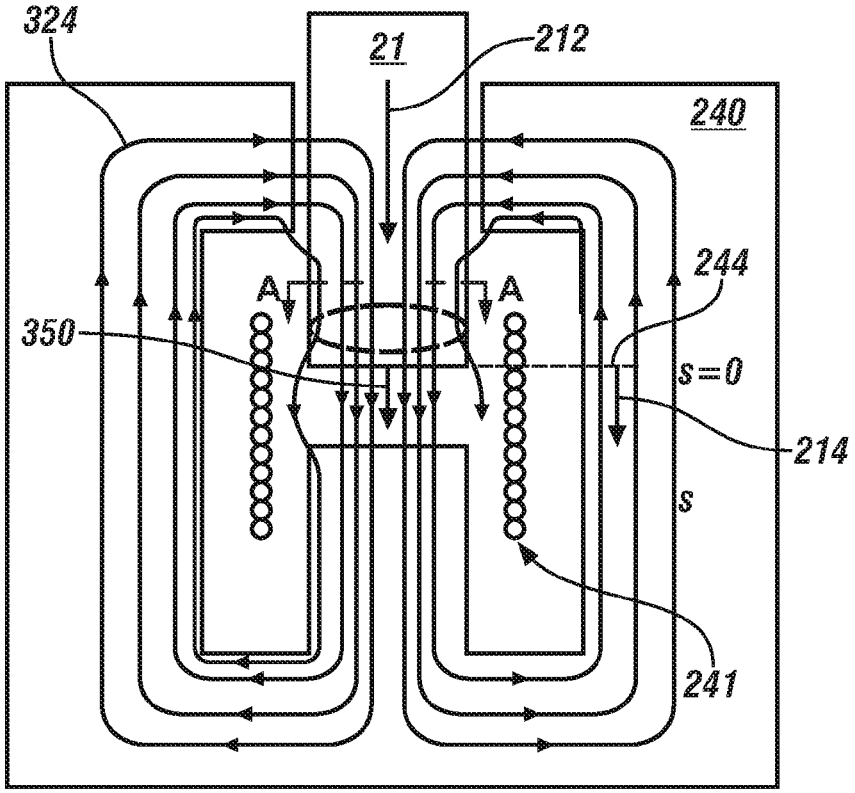
Figures 2, 3:
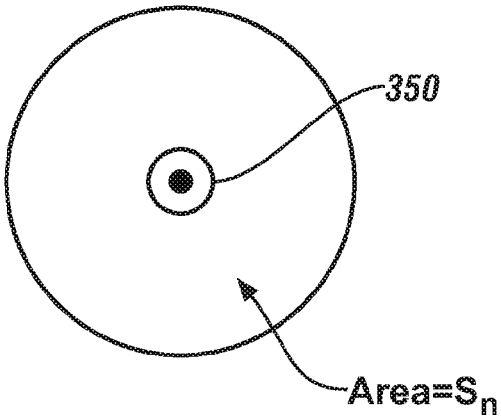

FIG. 3-1 illustrates a schematic sectional view of the armature portion 21, and the electromagnet assembly 24 of the fuel injector 10 of FIGS. 1 and 2 in the presence of magnetic flux, in accordance with the present disclosure. The electromagnet assembly 24 includes the annular electrical coil 241 and the stationary magnetic core 240. The electric coil 241 includes a prescribed number of turns, N. Magnetic flux follows the magnetic flux path 324 and is generated when the electrical coil 241 is energized by an electrical current provided from the injector driver 50. A magnetic flux density 350 at the armature portion 21 near an air gap along cross section A-A is further illustrated. It will be understood that the magnetic force 212 acting upon the armature portion 21 is determinative of the magnetic flux density 350 at the air gap of the armature portion 21 and not the magnetic flux path 324. For instance, portions of the magnetic flux path 324 entering the armature portion 21 in the radial direction cancel out and produce zero net force in the direction of armature motion. Further, the entire magnetic flux path 324 does not enter the armature portion due to portions of the magnetic flux path impinging, and therefore, not entering and exiting the armature portion in a direction normal to the armature portion 21. In other words, the magnetic flux density 350 accounts for only magnetic flux that is normal to the armature portion 21 near the air gap.

The magnetic flux flowing in the path 324 can be determined based upon the flux-linkage determined from EQ. [5] (or other methods described above) and the prescribed number of turns, N, of the electrical coil 241 as follows.

$$\varphi \cong \frac{\lambda}{N} \qquad [7]$$

wherein $\phi$ is the magnetic flux, $\lambda$ is the flux-linkage of the electrical coil 241, and N is the prescribed number of turns of the electrical coil 241.

FIG. 3-2 illustrates the armature portion 21 near the air gap along cross section A-A of FIG. 3-1, in accordance with the present disclosure. The armature portion has a surface area, $S_a$. It will be understood that the surface area of the armature portion, the prescribed number of turns N, and other parameters can be stored within memory of the control module 60. The magnetic flux density 350 along the cross section A-A can be obtained using the magnetic flux determined from EQ. [7] as follows.

$$B_n \cong \frac{\varphi}{s_a} \qquad [8]$$

wherein $B_n$ is the magnetic flux density 350 of the armature portion 21 along cross section A-A, and $S_a$ is the surface area of the armature portion 21 near the air gap.

Referring back to FIG. 3-1, the magnetic force 212 acting upon the armature portion 21 can be determined from the magnetic flux density 350 determined from EQ. [8] as follows.

$$f_{mag} \cong \frac{s_a \cdot (B_n \cdot b(s, \varphi))^2}{2\mu_o} \qquad [9]$$

wherein $\mu_o$ is the permeability of free space, and b is a correction factor that is a function of armature position s and flux $\phi$.

Accordingly, the magnetic force 212 acting upon the moving armature 21 can be obtained utilizing EQ. [9] and inserted into EQ. [6] to determine the position, velocity, and/or acceleration parameters (i.e. position, velocity, and acceleration terms) of the moving armature portion 21.

Information provided via the feedback signal(s) 42 of FIG. 1 allows the control module 60 (or ECM 5) to execute the transient armature model 200 of FIG. 2 to obtain the flux linkage and magnetic flux within the fuel injector 10 utilizing EQ. [6]. However, some embodiments may include the search coil 25, flux sensors, or magnetic field sensors to obtain the magnetic flux or flux-linkage, as described above with reference to FIG. 1. In turn, the closed loop operation of the transient armature model 200 can execute EQ. [6] to determine the instantaneous position, velocity, and/or acceleration parameters (i.e. armature motion parameters) of the moving armature portion 21 based upon the magnetic flux within the fuel injector 10. Having knowledge of the armature position and motion enables for precise fuel rates delivered to the combustion chamber and further allows for closely-spaced multiple, small quantity fuel injection events employed to reduce fuel consumption and emissions. Open loop operation which only accounts for current flow provided to the electromagnet assembly, to determine the armature position is often error prone due to residual flux presence and persistent eddy currents not accounted for.

Figure 4:
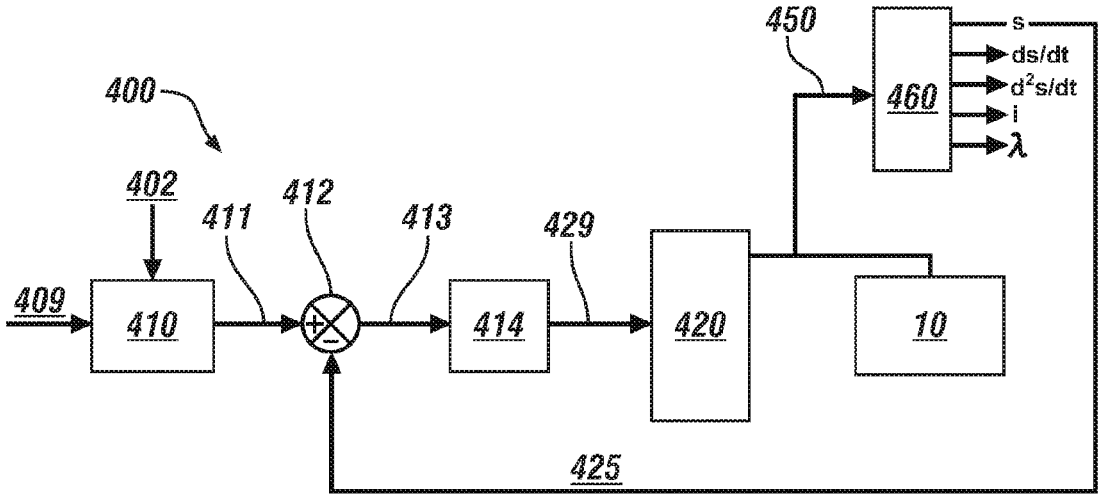
FIG. 4 illustrates a position control module, in accordance with the present disclosure.

FIG. 4 illustrates an exemplary embodiment of a position control module using armature position feedback to control current applied to an electrical coil of a fuel injector for controlling activation thereof. The position control module 400 may be implemented within—and executed by a processing device of—the control module 60 of the activation controller 80 of FIG. 1.

Accordingly, the position control module 400 will be described with reference to FIG. 1. The position control module 400 includes a position command generation (PCG) module 410, a difference unit 412, a proportional integral (PI) position control module 414, injector driver 420, and armature motion observer 460. The control module 60 of the activation controller 80 of FIG. 1 may encompass the PCG module 410, the difference units 412, the PI position control module 414, and armature motion observer 460. The injector driver 50 of the force activation controller 80 of FIG. 1 may encompass the injector driver 420. However, the control module 60 and injector driver 50 may encompass different combinations of those features listed above.

In the illustrated embodiment, a desired fuel flow mass 409 is input to the PCG module 410. Using The desired fuel flow mass 409 may be provided from an external module, e.g., the ECM 5, based on the aforementioned input parameters 51 for achieving a desired injected fuel mass, as described above with reference to FIG. 1. The PCG module 410 outputs an armature position command 411 based on the desired fuel flow mass 409 and other inputs 402, for example fuel pressure, which have material effects upon the fuel delivery through the injector. PCG module may operate under any well-known principles including look-up tables or equations to yield an output. The armature position command 411 is indicative of a command to establish an armature position required to activate the fuel injector 10 in the open position to deliver the desired fuel flow mass 409 to the combustion chamber 100. However, it will be appreciated that the armature position command 411 does not account for the presence of residual flux, e.g., magnetic flux, present within the fuel injector due to hysteretic and eddy current effect. The presence of residual flux may cause instability within the fuel injector that may impact fuel flow mass and injected fuel masses being delivered to the combustion chamber. Accordingly, moving the armature portion 21 based solely upon the armature position command may result in a fuel flow mass actually delivered to the combustion chamber that deviates from the desired fuel flow mass 409 thereby resulting in an inaccurate injected fuel mass being delivered to the fuel injector 10.

The armature position command 411 is input to the difference unit 412. The difference unit 412 compares armature position feedback 425 within the fuel injector 10 to the armature position command 411. The armature position feedback 425 is output from the armature motion observer 460 based upon injector parameter inputs 450 provided from the fuel injector 10. The injector parameter inputs 450 indicate the active magnetic flux present within the fuel injector 10 as described herein above and may include main coil voltage, main coil current, sense coil voltage or magnetic field sensor(s). The active magnetic flux, or equivalent flux linkage, present within the fuel injector 10 can be obtained by any of the methods as described above with reference to the illustrated embodiment of FIG. 1 using one or more sensing devices and integrated into the fuel injector 10 and corresponding injector parameter inputs. Based upon known relationships as described above with respect to the motion equation EQ. [6], the armature motion observer 460 can provide positional information (i.e. position (s), velocity (ds/dt), and acceleration ($d^2s/dt$)) corresponding to the armature. As well, since flux-linkage $\lambda$ may be determined within armature motion observer 460 from the injector parameter inputs 450, it too may be provided as an output. Particularly with respect to the present embodiment the armature position (s) is provided as armature position feedback 425. Thus, the armature position feedback 425 accounts for all forces acting on the armature including force attributable to residual flux in the presence of the active magnetic flux within the fuel injector 10.

Based upon the comparison between the armature position feedback 425 and the armature position command 411, the difference unit 412 outputs an adjusted armature position command 413 that takes into account the presence of magnetic flux within the fuel injector 10. The adjusted armature position command 413 is input to the PI position control module 414 whereby PWM electric power flow signal 429 is generated and input to the injector driver 420. Thus, the commanded PWM electric power flow signal 429 accounts for armature position feedback 425 within the fuel injector. Therefore, the position control module 400 enables a desired fuel flow mass 409 to be achieved for each one of a plurality fuel injection events in rapid succession using closed loop operation based upon the armature position feedback 425 within the fuel injector 10.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A method for controlling an electromagnetic actuator including an electrical coil, a magnetic core, and an armature comprising a position dependent mass adjacent the magnetic core, comprising:

determining a magnetic flux within the actuator when the electrical coil is energized by a current;

determining a magnetic force acting upon the armature based upon the magnetic flux, a surface area of the armature near an air gap between the magnetic core and armature, and armature position;

applying the magnetic force as a forcing function upon a mechanical equation of motion corresponding to the actuator to determine at least one armature motion parameter; and controlling the actuator based upon said at least one armature motion parameter.

2. The method for controlling the electromagnetic actuator of claim 1, wherein determining the magnetic flux within the actuator, comprises determining the magnetic flux based upon a search coil voltage.

3. The method for controlling the electromagnetic actuator of claim 1, wherein determining the magnetic flux within the actuator, comprises determining the magnetic flux based upon an electrical coil voltage.

4. The method for controlling the electromagnetic actuator of claim 1, wherein determining the magnetic flux within the actuator, comprises determining the magnetic flux based upon a magnetic field sensor signal.

5. The method for controlling the electromagnetic actuator of claim 1, wherein determining the magnetic force acting upon the armature comprises determining the magnetic force in accordance with the following relationship:

$$f_{mag} \cong \frac{s_a \cdot (B_n \cdot b(s, \varphi))^2}{2\mu_o}$$

wherein $f_{mag}$ is the magnetic force, $S_a$ is the surface area of the armature near the air gap, $B_n$ is the flux density $$\left(\frac{\varphi}{s_a}\right)$$

of the armature near the air gap, $\mu_o$ is the permeability of free space, and b is a correction factor that is a function of armature position s and flux $\phi$.

6. The method for controlling the electromagnetic actuator of claim 1, wherein the mechanical equation of motion is represented by the following relationship:

$$f_{mag} = m\frac{d^2s}{dt^2} + f$$

wherein $f_{mag}$ is the magnetic force acting upon the armature, m is a moving mass of the armature, s is armature position, and $f$ is an aggregate force acting upon the armature.

7. The method for controlling the electromagnetic actuator of claim 1, wherein said at least one armature motion parameter comprises position.

8. The method for controlling the electromagnetic actuator of claim 1, wherein controlling the actuator based upon said at least one armature motion parameter comprises providing said at least one armature motion parameter in feedback in an armature position control module.

9. The method for controlling the electromagnetic actuator of claim 8, wherein said armature position control module comprises an armature motion observer.

10. A system for controlling actuation of a fuel injector, comprising:

a fuel injector comprising an electrical coil, a magnetic core, and an armature comprising position dependent mass comprising a moving mass of a first portion of the armature and a moving mass of a second portion of the armature;

a controllable drive circuit responsive to a power flow signal for driving current through the electrical coil to actuate the armature; and a control module configured to determine an armature motion parameter in the fuel injector and adapt the power flow signal based on the armature motion parameter.

11. The system for controlling actuation of the fuel injector of claim 10, wherein said control module comprises an armature motion observer configured to determine said armature motion parameter based upon a magnetic flux within the fuel injector.

12. The system for controlling actuation of the fuel injector of claim 11, further comprising a search coil mutually magnetically coupled to the electrical coil, said control module further configured to determine said magnetic flux within the fuel injector based on the search coil.

13. The system for controlling actuation of the fuel injector of claim 11, further comprising a magnetoresistive sensor disposed within a flux path within the fuel injector, said control module further configured to determine said magnetic flux within the fuel injector based on the magnetoresistive sensor.

14. The system for controlling actuation of the fuel injector of claim 11, further comprising a hall effect sensor disposed within a flux path within the fuel injector, said control module further configured to determine said magnetic flux within the fuel injector based on the hall effect sensor.

15. The system for controlling actuation of the fuel injector of claim 11, wherein said armature motion observer:

determines a magnetic flux within the actuator when the electrical coil is energized by a current;

determines a magnetic force acting upon the armature based upon the magnetic flux, a surface area of the armature near an air gap between the magnetic core and armature, and armature position; and applies the magnetic force as a forcing function upon a mechanical equation of motion corresponding to the actuator to determine said armature motion parameter.

16. The system for controlling actuation of the fuel injector of claim 15, wherein the magnetic force acting upon the armature is determined in accordance with the following relationship:

$$f_{mag} \cong \frac{s_a \cdot (B_n \cdot b(s, \varphi))^2}{2\mu_o}$$

wherein $f_{mag}$ is the magnetic force, $S_a$ is the surface area of the armature near the air gap, $B_n$ is the flux density $$\left(\frac{\varphi}{s_a}\right)$$

of the armature near the air gap, $\mu_o$ is the permeability of free space, and b is a correction factor that is a function of armature position s and flux $\phi$.

17. The system for controlling actuation of the fuel injector of claim 15, wherein the mechanical equation of motion is represented by the following relationship:

$$f_{mag} = [k_1(s)m_1 + k_2(s)m_2 + \ldots]\frac{d^2s}{dt^2} + c(s, T)\frac{ds}{dt} + k(s, T)s + f_{plp}(s, p) + f_{pl}(T)$$

wherein $f_{mag}$ is the magnetic force acting upon the armature, $m_1$ is the moving mass of the first portion of the armature, $m_2$ is the moving mass of the second portion of the armature, $k_1(s)$ is equal to 1 when the first portion of the armature is moving, $k_2(s)$ is equal to 0 when the first and second portions of the armature are decoupled and is equal to 1 when the first and second portions are coupled, c is a viscous damping coefficient which may be a function of armature position and temperature, p is a fuel pressure at the fuel injector, k is a spring constant of a spring acting upon the armature which may be a function of armature position and temperature, s is armature position, $f_{plp}$ is a position and fuel pressure dependent force upon the armature in the closed position, $f_{pl}$ is a preload of the spring which may be a function of temperature, and T is temperature.

18. A system for controlling actuation of an electromagnetic actuator, comprising:

an actuator comprising an electrical coil, a magnetic core, and an armature comprising position dependent mass comprising a moving mass of a first portion of the armature and a moving mass of a second portion of the armature;

a controllable drive circuit responsive to an electric power flow signal for driving current through the electrical coil to actuate the armature; and a control module comprising an armature motion observer determining an armature motion parameter in the actuator based upon a magnetic flux within the actuator and a predetermined mechanical equation of motion corresponding to the actuator and adapting the electric power flow signal based on the armature motion parameter.

* * * * *